US005631039A

United States Patent [19]

Knight et al.

[11] Patent Number: 5,631,039

[45] Date of Patent: May 20, 1997

[54] SECURITY THREAD, A FILM AND A METHOD OF MANUFACTURE OF A SECURITY THREAD

[75] Inventors: Malcolm R. M. Knight; Duncan H. Reid, both of Basingstoke; Jeffrey A. Harrison, Hawarden, all of United Kingdom

[73] Assignee: Portals Limited, London, England

[21] Appl. No.: 289,440

[22] Filed: Aug. 12, 1994

[51] Int. Cl.[6] ..... B41M 3/14; B05D 5/12

[52] U.S. Cl. ..... 427/7; 427/129; 427/130; 427/131; 427/132; 427/258; 427/259; 427/260; 427/261; 427/262; 427/293; 427/304; 427/305; 427/306; 427/404

[58] Field of Search ..... 427/7, 129, 130, 427/132, 304, 305, 282, 293, 131, 404, 258–261, 306, 412.1

[56] References Cited

U.S. PATENT DOCUMENTS

| | | | |
|---|---|---|---|
| 2,702,253 | 2/1955 | Bergström et al. . | |
| 4,006,047 | 2/1977 | Brummett et al. | 427/307 |
| 4,066,804 | 1/1978 | Andrews | 427/305 |
| 4,368,281 | 1/1983 | Brummett et al. | 523/458 |
| 4,652,013 | 3/1987 | Azzato | 281/46 |
| 4,652,015 | 3/1987 | Crane | 283/91 |
| 4,910,072 | 3/1990 | Morgan et al. | 428/212 |
| 4,943,093 | 7/1990 | Melling et al. | 283/83 |
| 5,075,037 | 12/1991 | Morgan et al. | 252/513 |
| 5,082,734 | 1/1992 | Vaughn | 428/411.1 |
| 5,227,223 | 7/1993 | Morgan et al. | 428/209 |

FOREIGN PATENT DOCUMENTS

| | | |
|---|---|---|
| 0310707 | 4/1989 | European Pat. Off. . |
| 0319157 | 7/1992 | European Pat. Off. . |
| 1127043 | 9/1968 | United Kingdom . |
| 1585533 | 3/1981 | United Kingdom . |

OTHER PUBLICATIONS

A. Brenner et al., "Nickel Plating on Steel by Chemical Reduction" in *J. Research of Nat. Bur. Standards*, vol. 37, Jul. 1946, pp. 31–34.

D. Pearce et al., "A New 2-½ Inch Thin Film Disk" in *Solid State Technology*, Oct. 1988, pp. 113–115.

International Publication WO 92/11142 to W. Kaule et al., based on PCT/EP91/02437, published Jul. 9, 1992.

Research Disclosure, Kenneth Mason Pub. Ltd., No. 32354, p. 178 (Mar. 1991)

J. S. Judge et al., "Very High Coercivity Chemically Deposited Co–Ni Films" in *Journal of Applied Physics*, vol. 36, No. 3, Mar. 1965, pp. 948–949.

M. G. Miksic et al., "The Relationship Between Coercivity . . . Cobalt–Phosphorus Films" in *Journal of the Electrochemical Society*, Apr. 1966, pp. 360–362.

Journal of the Electrochemical Society, vol. 109, No. 6, Jun. 1962, pp. 485–490.

International Publication No. WO 90/08367 of Philip B. Jones entitled "Coding Security Threads for Bank Notes And Security Papers," dated Jul. 26, 1990.

"Recent Representative Examples of Cobalt Electroless Plating Baths for Making Magnetic Layers in Magnetic Memory Disk Applications" no date.

J. S. Sallo et al., "Studies of High Coercivity Cobalt—Phosphorous Electrodeposits" in *Journal of Applied Physics*, vol. 33, No. 3, Mar. 1962, pp. 1316–1317.

G. Bate et al., "Hard Magnetic Films of Co–Ni–P" in *Journal of Applied Physics*, vol. 34, No. 4 (Part 2), Apr. 1963, pp. 1073–1074.

J.S. Sallo et al., "Magnetic Electrodeposits of Cobalt–Phosphorous" in *Journal of the Electrochemical Society*, vol. 109, No. 11, Nov. 1962, pp. 1040–1043.

J. S. Sallo et al., "Instability of the Fine Particle Structure of Certain Electrodeposits" in *Journal of Applied Physics*, vol. 34, No. 4 (Part 2), Apr. 1963, pp. 1309–1310.

*Primary Examiner*—Janyce Bell

*Attorney, Agent, or Firm*—Watson Cole Stevens Davis, P.L.L.C.

[57] ABSTRACT

The present invention relates in one aspect to a method of manufacture of a security thread suitable for use in security articles including security paper such as that used for banknotes. In the method a magnetic metal is deposited on a film of polymeric substrate as the substrate passes through a solution containing the magnetic metal and a preparatory operation is carried out on a surface of the substrate prior to immersion of the substrate in the solution. The preparatory operation ensures that magnetic metal is deposited on the substrate in a pattern such that when the security thread is produced from the film by cutting the film the magnetic metal on the security thread has a specific pattern and provides both a visually discernible security feature and a magnetically detectable security feature. In a second aspect the present invention provides a security thread for security paper such as banknotes, the security thread comprising a polymeric substrate catalytic material covering at least a portion of one surface at the polymeric substrate and a layer of electrolessly deposited magnetic metal covering at least a portion of the catalytic material with a depth in the range 0.01–3.0 μm. The layer of magnetic material has a specific pattern and provides the security thread with both a visually discernible security feature and a magnetically detectable security feature, the security thread having an average magnetic remanence in the range 0.001–0.05 emu $cm^{-2}$.

23 Claims, 2 Drawing Sheets

SECURITY THREAD, A FILM AND A METHOD OF MANUFACTURE OF A SECURITY THREAD

BACKGROUND OF THE INVENTION

1. Field of the Invention

The present invention relates to a security thread for security paper such as banknotes and to film which can be cut into security threads. The present invention also relates to a method of manufacture of a security thread suitable for use in security paper such as banknotes and other security articles.

2. The Prior Art

Our GB-A-1127043 describes security devices, such as security threads, comprising magnetic material. Such devices allow banknotes and other documents to be authenticated on high speed used note sorting machines and other devices by verification of the presence of the magnetic component.

Also, our GB-A-1585533 describes other security devices which combine a machine verifiable layer of magnetic material with another layer of a non-magnetic metal or luminescent substance, such other layer being in itself machine-detectable. Banknotes containing security devices conforming to the above two patents have been in widespread use for many years; accordingly, there are many banknote sorting machines around the world already fitted with detectors for magnetic security threads as mentioned above.

Furthermore, our EP-B-0319157 describes security paper containing a security thread which is predominantly metallised but has clear regions, at least some of which are wholly surrounded by metal, forming a repeating pattern, e.g., in the form of the characters of an alphabet. This is a strong public security feature and has been adopted by the banknote issuing authorities in many countries; this feature has become known in the art as the Cleartext feature. Furthermore, U.S. Pat. No. 4,652,015 describes paper with a security device with isolated characters of metal; security paper of this type has been used for a recent issue of the United States currency.

There is increasing interest from banknote issuing authorities in combining into the same security device the benefits of a strong public security feature with the covert properties of a machine-readable feature. In particular, there is a need to combine the very strong public security of the Cleartext feature described in EP-B-0319157 with the magnetic properties of the devices described in our two above-mentioned GB-A-1127043 and GB-A-1585533 such that the resultant security device is directly compatible with the widely established magnetic thread detectors already in use around the world.

The security device of PCT application WO92/11142 is an attempt to provide this combination. A security device conforming to this specification has been used commercially. A central region of the security device has a metallic appearance with clear regions forming characters; on either side of this central strip in the width direction, there are layers of magnetic material with obscuring coatings to provide the necessary magnetic component. This is, however, a generally unsatisfactory means of achieving the combination of the appearance of Cleartext with the required magnetic properties. The resultant thread is wide (2.0 mm or more) which presents processing problems to but the papermaker and banknote printer. The magnetic properties are satisfactory, but the requirement to place the magnetic layers on either side of the central region means that the latter must be relatively narrow with respect to the overall thread width and results in characters which are small —typically 0.7 mm high—and therefore not easily legible. Additionally, the structures of the devices described in WO 92/11142 are very complex and present substantial lateral registration problems in depositing the various layers; misregister of even 0.1 mm or can allow the presence of the dark magnetic oxide to be apparent to the naked eye, thus revealing its presence and seriously detracting from the aesthetic appearance of the security thread.

A more satisfactory solution from the points of view of processability, ease of character recognition and aesthetics would be to manufacture a device of the kind described in EP-B-0319157 from a metal which is itself magnetic, such that the size of characters and ratio of character height:thread width of the Cleartext product is maintained, while providing direct compatibility with existing magnetic thread detectors. One means of achieving this is disclosed in Research Disclosure issue 323, page 178, of March 1991. In this disclosure, a magnetic metal is deposited onto a flexible substrate for example by vacuum sputtering; the non-metallised regions are created by selective printing of a resist and subsequent chemical etching. The disclosed magnetic metals may be nickel, cobalt, iron or alloys thereof with a preferred combination of cobalt:nickel in the ratio 85:15. The disadvantage of this method is that vacuum deposition of cobalt:nickel to the necessary thickness is a relatively slow process and somewhat wasteful of cobalt, which is an expensive material. Furthermore, subsequent to this vacuum deposition process, further significant processing is required to etch the characters. The resultant product is therefore relatively expensive.

It is known that films of cobalt:nickel:phosphorous can be prepared by electrodeposition and of cobalt:phosphorous by electrolytic and chemical reduction (Journal of Applied Physics, Vol. 36, No. 3 March 1965, page 948). This paper describes the preparation of films of cobalt:nickel:phosphorous by chemical reduction (electroless plating) using a tin chloride:palladium chloride catalyst. The paper also shows that the magnetic coercivity is strongly dependent upon the nickel content of the alloy. Another paper on the electroless deposition of cobalt phosphorous films has shown that the coercivity is dependent upon the phosphorous content (Journal of the Electro Chemical Society, April 1966, page 360). Again, activation of the substrate involves a catalyst based on tin chloride:palladium chloride. In both of the above papers, a continuous magnetic metallic film is generated (continuous on a macro scale).

Electroless deposition of cobalt on polyethyleneterephthlate (PET) sometimes called Mylar (a trade mark), a non-conductive substrate, is described in the Journal of the Electrochemical Society, June 1962, page 485. In the experimental procedure described, Mylar was immersed in an adhesive and then successively in stannous chloride and palladium chloride solutions prior to deposition of the cobalt layer. The resulting film was suitable for use in high-density data storage applications.

U.S. Pat. No. 5,227,223 discloses a process for electrolessly depositing metal on to a pattern of catalytic material printed on to a moving web of polymeric film so as to form electronic circuits on the film or electrical components or micro-engineering components. The process provides metal images having fine dimensions, e.g., as low as 25 μm or less. U.S. Pat. No. 5,227,223 makes mention of several prior specifications which use electroless deposition to produce printed circuits. These prior specifications all discuss the deposition of some metals which are non-magnetic as would be expected in the manufacture of electrical currents where magnetised components would be disadvantageous. The preferred embodiment of the process of U.S. Pat. No. 5,227,223 uses a nickel bath and deposits nickel onto a substrate by electroless deposition; nickel deposited in such a manner is non-magnetic.

SUMMARY OF THE INVENTION

The present invention in a first aspect provides a method of manufacture of a security thread suitable for use in security paper such as banknotes, wherein a magnetic metal is deposited on a film of polymeric substrate as the substrate passes through a solution containing the magnetic metal, and a preparatory operation is carried out on a surface of the substrate prior to immersion of the substrate in the solution, characterised in that the preparatory operation ensures that magnetic metal is deposited on the substrate in a chosen pattern such that when the security thread is produced from the film by cutting the film, the magnetic metal in the resulting security thread has a specific pattern and provides both a visually discernible security feature and a magnetically detectable security feature.

The present invention in a second aspect provides a security thread for security paper, such as banknotes, the security thread comprising: a polymeric substrate, catalytic material covering at least a portion of one surface of the polymeric substrate, and a layer of electrolessly deposited magnetic metal covering at least a portion of the catalytic material with a depth in the range of 0.01–3.0 μm, wherein the layer of magnetic metal has a specific pattern and provides the security thread with both a visually discernible security feature and a magnetically detectable security feature, the security thread typically, but not exclusively, having an average magnetic remanence in the range 0.001–0.05 emu $cm^{-2}$.

For the purposes of this specification the term "magnetic remanence" refers to the remanent moment per unit area (equivalent to the remanent magnetisation—thickness product).

In a third aspect the present invention provides a film which can be cut into security threads for security paper such as banknotes, the film comprising: a polymeric substrate, catalytic material covering at least a portion of one surface of the polymeric substrate, and a layer of electrolessly deposited magnetic metal covering at least a portion of the catalytic material in a layer of magnetic metal with a depth in the range 0.01 μm–3.0 μm, wherein the layer of magnetic metal has a chosen pattern such when a security thread is cut from the film the layer of magnetic metal provides both a visually discernible security feature and a magnetically detectable security feature, the security thread having a magnetic remanence in the range 0.001–0.05 emu $cm^{-2}$.

The present invention is directed at the production of patterned magnetic/metallic films for use as a security thread based on the electroless deposition of a magnetic metal layer preferably comprising cobalt with or without nickel, iron and/or phosphorous. The disadvantages of producing this product using a vacuum deposited film have been discussed above. It is advantageous to produce the required pattern in the magnetic metal at the time the metal layer is formed, so that no further processing of the magnetic metal layer is required, other than for example to apply protective/adhesive coatings and to slit a film bearing the magnetic pattern into security threads.

As will be seen later the magnetic metal is not deposited evenly over the whole of a security thread, thus the figures given for depth of metal are for regions of thread having magnetic metal therein and remanence and coercivity values are given as averages.

The depth of the layer of catalytic material is preferably in the range 0.2–0.5 μm.

Where it is stated above and in the claims that the solution contains magnetic metal, it should be appreciated that the magnetic metal will present as ions in the solution and typically a salt will be dissolved in the solution to provide ions (which only take the form of magnetic metal after deposition). Where it is stated above and in the claims that the magnetic metal is deposited on the substrate (or on catalytic material), it should be appreciated that the magnetic metal could be deposited directly or indirectly on the substrate (or directly or indirectly on the catalytic material). Indeed, in all of the examples given later the magnetic metal is not deposited directly on the substrate but on a material provided on the surface of the substrate (and in some examples the metal is not deposited directly on catalytic material, but on a metal deposited on the catalytic material).

Examples of preferred methods of manufacture will now be described, along with preferred embodiments of security thread according to the invention, with reference to the accompany drawings.

DETAILED DESCRIPTION OF THE PREFERRED EMBODIMENTS

Figure 1:
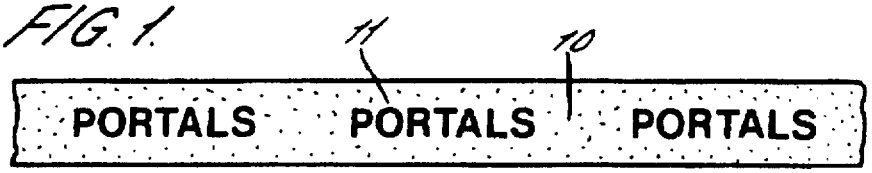
FIG. 1 illustrates a first embodiment of security thread.

Preferably, a suitable clear substrate, typically polyethyleneterephthlate (PET) 12 to 23 μm thick, is printed with a catalyst containing palladium or palladium:tin in a pattern which corresponds to the chosen end pattern of the magnetic metal. It is preferred that a tin-free palladium catalyst is used because it is easier to print than currently available palladium catalyst solutions which contain tin. It is essential to ensure good printing/print adhesion so that the catalytic material does not flake off from the substrate later on in the manufacturing process. U.S. Pat. No. 5,227,223 gives in example 1 five different catalytic inks which may be suitable for use in methods according to the present invention. Specific examples of suitable catalytic inks are given in the examples which appear later in this application.

After the catalyst has been printed the film is dried and optionally treated with heat or by other known means to optimise the catalytic properties of the catalytic layer. The film is then immersed in a plating bath of known composition such that electroless deposition of cobalt with or without nickel, iron and/or phosphorous or alloys thereof is formed over the printed catalyst and provides the chosen pattern of magnetic metal. This may be undertaken by conveying a web through the plating bath at a speed commensurate with building up the desired metal thickness. Preferably, the metal thickness is in the region 0.2 μm–0.5 μm, although metal thicknesses outside this range can be achieved as required for a given magnetic detection system, for example 0.01 to 3.00 μm.

To provides adequate magnetic properties the deposited magnetic metal will typically have over 50% cobalt and preferably over 80% cobalt. It is preferred to deposit a magnetic metal which is an alloy of cobalt with phosphorous and/or cobalt phosphide. Variation of the percentage of phosphorous or cobalt phosphide in the deposit enables variation of magnetic properties of the deposit.

After emerging from the plating bath, the plated film is rinsed in deionised water and dried. Protective and/or adhesive coatings are then applied to one or both sides of the film, as required. As a matter of practicality it is very important to apply a transparent barrier coating to protect the magnetic metal from subsequent mechanical abrasion and chemical or atmospheric attack; the magnetic metal would otherwise be vulnerable when used on security thread. Most suitable barrier coatings are applied as lacquers or emulsions. Some have the effect of modifying the appearance of the magnetic metal and making it more difficult to copy or simulate the security thread for counterfeiting purposes. Suitable barrier coating include vinyl copolymers (e.g., copolymers of vinyl chloride and vinyl acetate), polyvinylidene chloride (PVdC), acrylics, polyamides and copolymers of vinylidene chloride and acrylonitrile. These can applied by several suitable operations (e.g., gravure coating, reverse roll coating) to a preferred dry coating mass of 1–3 $gm^{-2}$. Suitable adhesive coatings include extrusion coatings, e.g., copolymers of ethylene and vinyl acetate and ionomers (e.g., based upon a copolymer of ethylene and methacrylic acid), hot melt adhesives, polyurethanes, polyamide copolymers and emulsions (e.g., copolymers of ethylene and acrylic acid). These materials can provide barrier properties in addition to adhesive properties. They can be applied by several suitable operations, e.g., gravure coating for emulsions and solutions, to a dry mass preferably in the range 3–12 $gm^{-2}$. Other coatings can be applied by extrusion and hot/ melt techniques.

The film is next cut mechanically using known techniques to produce strips with width dimensions typically 0.5–4.0 mm and, more typically, 1.0–2.0 mm, although other widths may be selected, for example 5.0 mm or more. The security thread which results from this mechanical cutting is then incorporated into paper in embedded or windowed form according to known techniques. The security thread can also be used in a security card where it is typically sandwiched between two layers of a card (in this use security threads are sometimes termed security strips).

Figure 3:
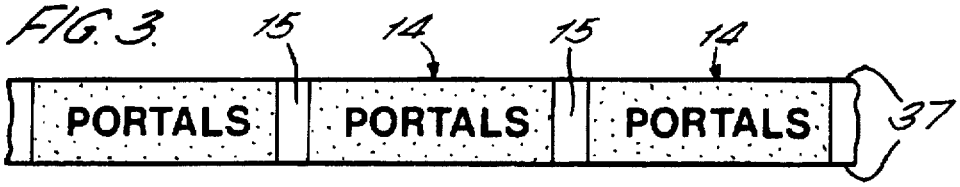
FIG. 3 illustrates a third embodiment of security thread.
Figure 4:
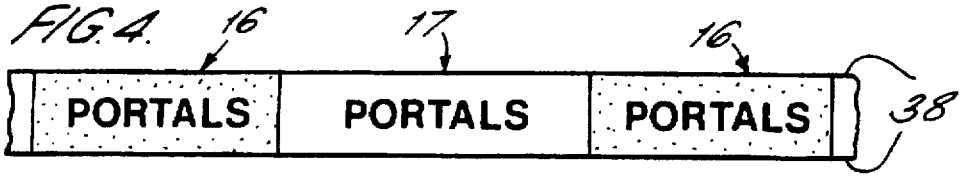
FIG. 4 illustrates a fourth embodiment of security thread.
Figure 5A:
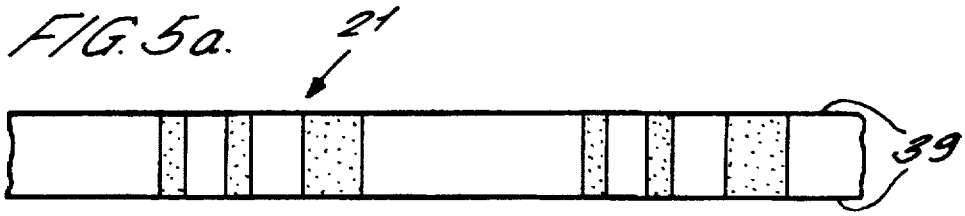
FIGS. 5*a*, 5*b* and 5*c* illustrate fifth, sixth and seventh embodiments of security thread.
Figure 5B:
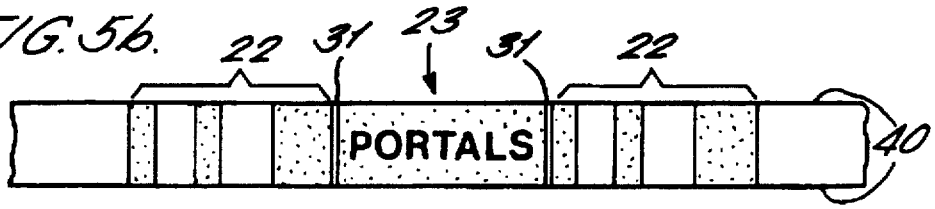
Figure 5C:
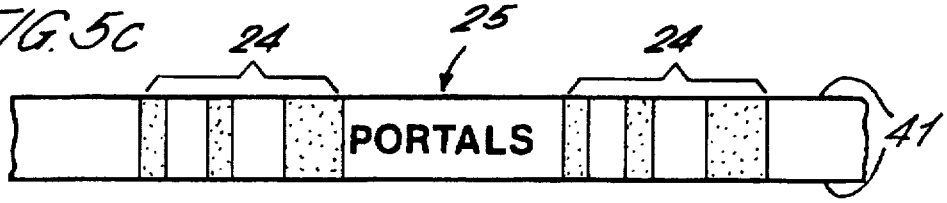

The design of the chosen pattern of the printed catalyst and subsequent magnetic metal layer is chosen in accordance with the end user requirements. Preferably, the specific pattern on the security thread corresponds to the Cleartext concept as described in EP-B-0319157 and shown in FIG. 1; which shows a security thread comprising a clear substrate which is covered with a magnetic metal layer 10, with the letters 11 of the word PORTALS being formed from clear metal free regions in the metal layer 10. However, it is also possible to produce discrete metal characters as described in U.S. Pat. No. 4,652,015 and shown in FIG. 2, in which metal characters 13 are deposited on a clear substrate 11 (the substrate being metal free a apart from the metal forming the letters). It should be appreciated that the lines 36 in FIG. 2 merely illustrate the edges of the security thread and do not indicate the presence of deposited magnetic metal. The Cleartext design could also be produced in blocks as shown in FIG. 3, in which the blocks 14 of metal free characters are separated by gaps 15, which extend completely across the width of the thread and define isolated conductive blocks of magnetic metal each with a specified length which is important for radio frequency or microwave detection. It should be appreciated that the lines 37 where they appear in the metal free zones serve only to illustrate the edges of the security thread and do not indicate the presence of deposited magnetic metal. It is further possible to produce designs which combine mixtures of the concepts of the above two specifications, i.e., a thread which has regions of metal characters as described in the above noted U.S. patent and also regions of metal free characters as described in the European specification, as shown in FIG. 4, in which regions of metal free characters such as 16 are separated by regions of metal characters such as region 17. Again in this embodiment isolated conductive blocks of specified lengths are provided in the regions of metal free characters, which is important for radio frequency and microwave detection. The lines 38 where they appear in the regions of metal characters (e.g., 17) serve only to illustrate the edges of the security thread and not indicate the presence of deposited metal. The characters will typically be symbols such as alphanumeric characters or characters for written languages such as Japanese, Chinese or Arabic. Alternatively the specific pattern could be in the form of a machine readable code such as a bar code. FIGS. 5*a*, 5*b* and 5*c* show examples of such a bar code or its own (in FIG. 5*a* a region 21 of bar code is shown) and combined with non-coded regions forming a text (in FIG. 5*b* a region 23 with metal free characters is shown separated from two bar code regions 22 by gaps 31 and in FIG. 5*c* a region with metal characters is shown separating two bar code regions 24). It should be appreciated that the lines 39, 40 and 41 serve only to mark the edges of the security threads and do not indicate the presence of deposited magnetic metal at the edges of the metal free regions or the regions with metal characters. In all forms the pattern intrinsically embodies optically readable information which may be determined by visual inspection and/or by machine.

Figure 6:
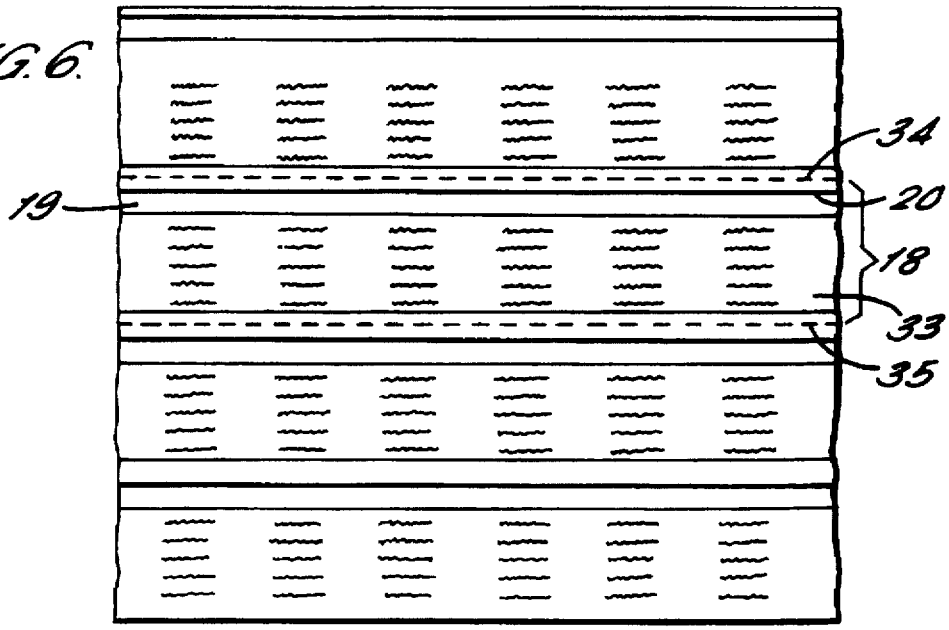
FIG. 6 illustrates a part printed film ready for slitting into security threads, as provided in an intermediate stage of the method of the present infection.

It will be appreciated that a number of security threads can be manufactured from one film; this is illustrated in FIG. 6. The film contains several bands 18 called in the art "ribbons". Each ribbon 18 comprises a section of printed text (e.g., section 33) a tracking line (e.g., 20) and an unprinted gap (e.g., 19) between the section of printed text (e.g., 33) and the tracking line (e.g., 20). The dotted lines 34 and 35 indicate the boundaries of the ribbon 18. Whilst for clarity only a small number of lines of text are shown in each text section in the FIG. 6, in practice a text section typically has twenty to fifty lines of text and a ribbon is typically 30–90 mm wide. Tracking lines are not required where there is no requirement for lateral registration between text and thread. The ribbons are slit from the film and the threads then slit from the ribbons.

The magnetic metal present on a security thread slit from the film provides two security features in that it is visually discernible (e.g., it defines alphanumeric characters) and is magnetically detectable (thereby being suitable for use with known magnetic detectors used for security threads).

Magnetic detection may take place in a number of ways. In the simplest form, only the presence of a magnetic material in the appropriate region of the security article, e.g., banknote, is determined, by assessing the magnetic remanence required with reference to a lower and optionally an upper threshold limit. Alternatively or additionally, measurement of the coercivity or other magnetic property of the magnetic content of the security thread may be made. In a more sophisticated detector, the specific pattern of the magnetic metal may be determined, as well as the aforesaid magnetic properties, by use of e.g., modified MICR (Magnetic Ink Character Recognition) detectors or by detectors designed to read a form of bar code. Other detection systems operate by writing a signal into the magnetic material and subsequently reading it back in a manner analagous to analogue or digital recording; such detectors must be configured to take into account the pattern in which the magnetic metal is present so that there is no unacceptable inteference with the recorded/replayed signal.

The magnetic metal can also allow the thread to be detected by other detection techniques making use of the metallic/conductive content (e.g., radio frequency or microwave detection, resonance and capacitive coupling).

The security thread is also suitable for use as magnetic strips in security cards. The security thread is preferably embedded in laminated cards or face mounted and again provides at least a visually discernible security feature and a magnetically detectable security feature. The magnetic metal can be deposited in the form of a bar code and/or a signal recorded using the magnetic metal of the security thread.

In a less preferred manufacturing method, the catalyst layer is applied uniformly over the PET substrate in accordance with known techniques and then dried/activated. A barrier coating is then applied in a pattern over the catalyst layer to isolate the underlying catalyst. The film is then immersed in the plating bath and metal is electrolessly deposited in the regions not covered by the barrier coating, i.e., the barrier coating must be printed in the reverse image to that of the chosen pattern of magnetic metal. Optionally, activation of the catalyst may follow the application of the harrier coating.

A different non-preferred method of producing the required end result is to print a conductive ink or coating in a specific pattern onto one side of a suitable substrate. A web of the substrate is then immersed in an electroplating hath and continual electrical contact made with the conducting printed pattern, e.g., by means of a conducting roller. The conducting ink layer then acts as the cathode for deposition byelectroplating from a suitable plating bath for the required magnetic metal/alloy, which is then deposited in the required pattern.

A further non-preferred method is to apply a tansparent conducting coating, e.g., of indium oxide, tin oxide or combination thereof to a clear flexible substrate such that it is uniformly coated all-over, provide an electrically resisting harrier coating in a specific pattern over the conducting layer and the deposit magnetic metal by electroplating in the non-printed regions. The barrier coating pattern must not interfere with electrical contact onto the conducting layer during the plating process.

A top layer of a different metal, including a non-magnetic metal, may be applied over the magnetic metal where the latter is generated by either the electroplating or electroless technique e.g., by running the magnetic metal plated film through a further electroplating bath with a suitable cathode connection as described above to deposit the top layer of such other metal, such as tin, nickel or copper or by running a film bearing electrolessly deposited magnetic metal through an electroless bath containing non-magnetic metal whilst the film is still wet (it has been found that there is enough catalytic activity present at the surface of the deposited magnetic metal to cause electroless deposition of the non-magnetic metal). Such other metal may be required to provide a modified appearance or other property to the upper surface of the magnetic metal.

An intermediate layer of non-magnetic metal can be deposited between the catalyst and the magnetic metal, e.g., using the electroless technique described in the previous paragraph (nickel is a preferred intermediate layer).

Optionally, the clear plastic substrate may have a dye or luminescing agent incorporated in it to provide colour to the film when viewed in the appropriate illumination. Further layers containing dyes, luminescing agents, optically active layers (e.g., thin film, dichroic, holographic/diffractive films) may be added to the basic film to further enhance the visual properties, as disclosed in our EP-B-0319157.

The security thread of the present invention could be designed to allow sensing by equipment commonly used to read magnetic ink text on a cheque i.e. magnetic ink character recognition apparatus. The signal provided by the magnetic metal on the thread would be particular to the pattern of the magnetic thread.

Security threads could be used for purposes other than for security articles, e.g., for tear tapes and other tamper evidencing devices for containers.

Examples of methods of manufacture of security threads, examples of catalyst inks for use in the methods, examples of uses of security threads made by the methods and examples of methods of detection are now given for purposes of illustration of the invention only:

Examples of Catalyst Inks

EXAMPLE 1

A catalyst ink is prepared by dissolving 0.08 kg of palladium acetate in a mixture of 1.6 l of water and 0.32 l of concentrated ammonium hydroxide; the molar ratio of ammonia to palladium was 13:7. The palladium solution is added to a solution of polyvinylalcohol (M.W. 25,000,88 mole percent hydrolysed) in water to produce a catalyst ink comprising 0.24 percent palladium with a viscosity of about 20 cp.

EXAMPLE 2

An aqueous, catalytic ink comprising palladium and a heat-curing vinyl copolymer is prepared by adding palladium acetate and phosphate ester plasticized vinyl chloride-vinyl acetate copolymer (Geon 590K20 (trade mark) copolymer from B.F. Goodrich Company) to an aqueous solution containing ethylene glycol monobutyl ether, a urethane block copolymer rheology modifier (OR-708 theology modifier from Rohm & Haas Company as a 35% solution of hydrophobically modified, nonionic, ethylene oxide based urethane block copolymer in 60/40 propylene glycol/water) and polyethylene oxide surfactant (Triton K-100 (trade mark) surfactant from Rohm & Haas Company) providing an ink the following composition:

vinylchloride copolymer—8.8 weight percent palladium—1.6 ""

ethylene glycol monobutyl—3.3 ""ether

Triton K-100—0.9 ""

QR-708—1.9 ""

Examples of Methods of Manufacture of Security Threads, Examples of Subsequent Uses of the Security Threads and Examples of Methods of Detection

EXAMPLE 1

Either of the catalyst inks of the examples given above is then used in a rotogravure printing press and transferred in a specific pattern from a gravure roll onto a moving web of 23 μm thick polyethylene terephthlate (PET, Hostaphan 4400 (trade mark)) unwound from a roll and travelling at a linear speed of 30 n/min. The printed film is next passed through an air drying oven (air temperature 40°–80° C., residence time about 3 s) to produce a catalytically inert film which is then re-wound. The printed film is next heat-activated by unwinding and passing at 3 m/min through a further oven with an air temperature of 160° C. and residence time 12 s to produce a catalytically-active film which is re-wound. The chosen catalyst pattern is chosen to produce eventually a security thread according to FIG. 1 with metal deposited in the region 10.

The roll of printed, activated film is next transported to a separate station, unwound and conveyed through an electroless plating bath made from a non-metallic substance and containing a plating solution formed as follows (CAS= Chemical Abstracts Service Registry Number):

150 l of distilled water 5.10 kg borax i.e. 34 g $l^{-1}$ (di-sodium tetraborate, Fisons AR grade CAS 1303-96-4)

5.10 kg sodium citrate i.e. 34 g $l^{-1}$ tri-sodium citrate, Fisons AR grade CAS 6132-04-3)

2.0 kg glycine i.e., 13.3 g $l^{-1}$ (glycine, Fisons AR grade CAS 56-40-6).

The above three components are dissolved in the water at 60° C. with air agitation.

The following three components are added to complete the electroless plating bath:

Cobalt sulphate solution to bring to 1.9 g $l^{-1}$ (cobalt sulphate, Fisons AR grade CAS 10026-24-1)

Sodium hypophosphite solution to bring to 13.0 g $l^{-1}$ (sodium hypophosphite monohydrate, Fisons AR grade CAS 10039-56-2)

Sodium hydroxide solution or sulphuric acid addition to the solution to bring the pH to 9.6.

The tank is equipped with PTFE-coated heaters, a pulp for continuous filtration of the solution, and an air line for air agitation of the solution prior to plating.

The bath is operated at 70° C. in order to ensure the solubility of the components and to reduce the concentration of dissolved oxygen. Matrix experiments have been conducted in which all the components were varied in a systematic manner and the magnetic properties of the resulting magnetic cobalt layer and the metal deposition rate were measured, showing that the bath could meet the specifications demanded in the production of the magnetic film required for the invention. The exact electroless bath composition, especially of sodium hypophosphite, cobalt sulphate, and glycine had a profound effect on the magnetic properties of the deposited magnetic layer. However, the magnetic properties of the deposited cobalt could be changed in a controlled and understandable manner be varying the chemical components in the bath. A feature of the electroless deposition of cobalt (present as cobalt metal or cobalt phosphide), is that an induction time is observed before plating commences (typically 10–30 s but it can be longer or shorter and is thought to be due to the need to remove excess dissolved oxygen); this is followed by a steady deposition rate of typically 1 $nms^{-1}$ metal thickness.

Increasing the concentration of hypophosphite increases both the magnetic coercivity and metal deposition rate. Increasing the cobalt concentration decreases the coercivity by increasing the size of the metal alloy crystallites; conversely, reducing the cobalt concentration increases the coercivity by reducing the size of the crystallites. Increasing or decreasing the concentration of glycine reduces the coercivity. Nickel sulphate or zinc sulphate can also be added to further modify the deposition rate or the magnetic properties, especially to raise the coercivity to the particular requirement. Experiments have showed that the rate of magnetic metal deposition is constant, to the thickness of the uniform magnetic layer increased linearly with time.

After plating, the film is conveyed through a series of rinsing tanks containing deionised water, dried and rewould. The cobalt-based magnetic metal is present on the film in a manner similar to FIG. 6, with transparent metal-free letters forming the text legend "PORTALS" in the text sections (e.g., 33). The magnetic characteristics of a portion of the film are determined by a B-H Looper; optionally a Vibrating Sample Magnetometer can be used. The portion of the film used in the B-H Looper or Vibrating Sample Magnetometer should be chosen to be of a size sufficient to give an average reading since the presence of the text leads to fluctuations in magnetic properties across the film; a 5 centimetre square area is typically but not exclusively used. Measurements are taken parallel to or transverse to the lines of text, according to the requirements of the magnetic detection system ultimately used to authenticate the security thread.

The roll of film is next transported to a coating machine. The roll is next unwound and conveyed through the machine. A barrier coating of a copolymer of vinyl chloride and vinyl acetate is gravure-coated from solution over the magnetic metal to a dry film weight of 2 $gm^{-2}$ and air-dried. The film is next re-wound returned to the input end of the coating machine and passed through again to apply an adhesive coating of an ethylene/acrylic acid copolymer emulsion on to both sides, giving a dry film weight of 5 $gm^{-2}$ each side.

The film is mechanically cut to ribbons on a ribbon slitter and then the ribbons are mechanically cut by a microslitter to produce security threads 1.4 mm wide; each thread comprised a region of magnetic metal forming 70% of the total area of one side with clear metal-free light-permeable regions comprising 30% of the total area of that side and forming the legend "PORTALS" as shown in FIG. 1.

Figure 7:
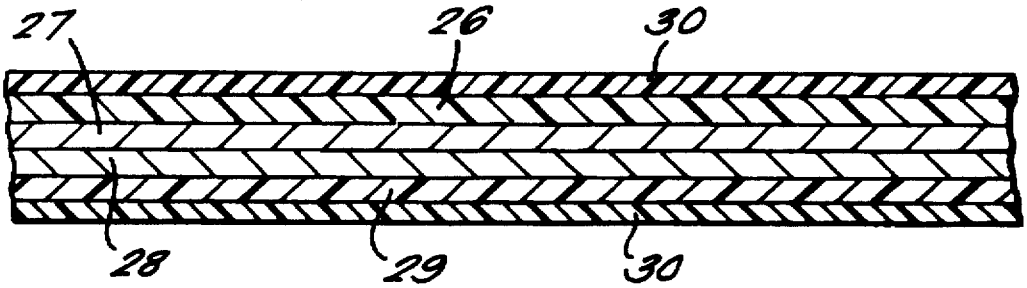
FIG. 7 is a cross-section through a part of one of the security threads illustrated in FIGS. 1 to 5*c*.

In FIG. 7 there is shown a cross-section through a port of the resulting security thread having magnetic metal deposited on a substrate. The film of polyethyleneterepthlate (PET, Hostaphan 4400) is shown as 29. The catalyst ink printed on the film 29 is shown as a layer 28. The deposited magnetic metal is shown as a layer 27. The barrier coating is shown as a layer 26. The two layers of adhesive are shown as two layers 30.

The individual security threads are incorporated into banknote paper on a cylinder mould machine such that they are wholly enclosed with fibre to form an embedded security thread. After conventional further processing, printing and distribution, banknotes incorporating the security thread are released into circulation on return to the central bank used note processing department, the banknotes are fed into a high-speel used note sorting machine. The magnetic content of the security thread is interrogated by a magnetic remanence detect or fitted to the sorting machine. Banknotes containing a security thread producing the correct range of remanance signals are directed for re-issue or destruction, according to their condition and fitness for re-issue. Banknotes not containing a security thread producing the correct remanence signal are directed to manual inspection as being potential counterfeits.

EXAMPLE 2

Figure 2:
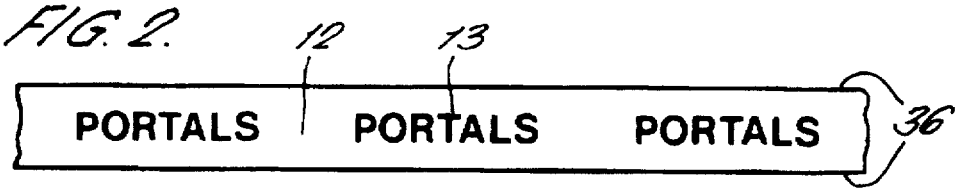
FIG. 2 illustrates a second embodiment of security thread.

As example 1 except that the catalyst is gravure-printed in a pattern such that the magnetic metal was deposited in such manner that security threads are produced with isolated metal characters according to FIG. 2.

EXAMPLE 3

As example 1 except that an extrusion coating of an ionomer based upon a copolymer of ethylene and methacrylic acid is deposited over both sides to a film weight of 12 $gm^{-2}$ to form a combined barrier and adhesive layer.

EXAMPLE 4

As example 1 except that the barrier coating is a copolymer of vinylidene chloride and acrylonitrile to a dry film weight of 2 $gm^{-2}$.

EXAMPLE 5

One of the catalyst inks given in the examples above is printed in a Cleartext pattern (to produce security threads as shown in FIG. 1) onto 23 μm thick PET film using a flexographic printing press at 21 m/min web speed and air dried. The dry ink pattern is heated for 1 minute in 190° C. air to activate the catalyst.

A cobalt electroless bath is prepared from cobalt sulphate heptahydrate, sodium citrate, sodium borohydride, ammonium sulphate, sodium hypophosphite and ammonia to provide an aqueous solution of pH 8.3. of the following composition:

cobalt—0.11 Molar citrate—0.14 "

borohydride—0.31 "

sulphate—0.76 "

hypophosphite—0.14 "

The printed activated film is passed through and immersed for 2 minutes in the cobalt plating bath at 55° C. providing a pin hole-free, magnetic cobalt deposit defining a pattern of sharp, metal-free characters.

The film is next further processed as described in example 1.

EXAMPLE 6

As example 5 except that the security threads is incorporated into paper on a cylinder mould machine in accordance with EP-A-0059056 to produce paper where the thread was exposed in windows on one side of the sheet.

EXAMPLE 7

As example 6 except that the magnetic detection on the used note sorting machine interrogates both the magnetic remanance and coercivity of the security thread. If either property is found to be outside the pre-set limits, the banknote is directed to manual inspection.

EXAMPLE 8

As example 5 except that the magnetic metal was deposited in a pattern chosen to enable production of security threads of the type shown in FIG. 3. During used note sorting, as well as interrogation of the magnetic remanance, a separate radio frequency or microwave detector interrogates the metallic content of the security thread to verify the specific distance of continuous metal between the breaks extending across the full width of the thread.

EXAMPLE 9

As example 6 except that during used note sorting, a separate metal detector based on capacitive coupling is used to interrogate the metal content of the security thread.

EXAMPLE 10

As example 1 except that the magnetic metal is deposited in a series of bars which eventually extend across the security thread in a bar code according to FIG. 5*a*. During used note sorting, a detector is used to verify both the magnetic remanence of the metallic content of the security thread and the magnetic code formed from the specific pattern in which the magnetic metal was deposited.

EXAMPLE 11

As example 2 except that a modified MICR-type detector (Magnetic Ink Character Recognition) is used to interrogate the individual characters to verify both their magnetic remanence and individual character design thus verifying the pattern formed from the characters.

EXAMPLE 12

As example 6 except that a modified MICR-type detector is used to verify the pattern of the magnetic metal and by magnetic means identify the pattern formed from the clear metal-free regions in the security thread.

EXAMPLE 13

As example 1 except that a magnetic metal is deposited to form a specific pattern on the security thread in which the characters are a mixture of metal and metal-free regions according to FIG. 4. During used note sorting, an optical detector is used to determine by optical means the pattern of the magnetic metal, complementing the verification of the presence of the metal by the magnetic detector. The optical detection is based on the interruptions in the optical transmission through the banknote in the infra-red region, i.e. the detector is a shadow type detector. In a further variant, the reflected light image of the metallic regions of the security thread is also detected and analysed and compared to the transmitted light image.

EXAMPLE 14

As example 6 except that the adhesive coatings applied to each side of the thread incorporates a pigment which fluoresced red when placed under a suitable UV excitation lamp.

EXAMPLE 15

A security thread is manufactured in accordance with example 1. The thread is then laid across a rectangular block of transparent or translucent plasticized polyvinyl chloride (PVC). A clear PVC laminating film is laid over the thread and the whole assembly placed in an embossing press heated to 180° C. After heating/pressing, the security thread is incorporated into a laminated plastic card with embossed information suitable for use as, e.g., an identity card. In order to verify the authenticity of the card, it is transported through a reading device incorporating a magnetic remanence detector such that the magnetic metal content of the security thread passses the detector head.

In a further embodiment, the security thread is encoded with information in a manner analagous to that used to encode magnetic stripes on credit and charge cards etc. The security thread thus combines the functions of such stripes with providing visual security for the general public.

Optionally, a photograph or other identifying device is incorporated within the laminated card.

EXAMPLE 16

A continuous web of 12 μm thick polyester is unwound from a roll and passed through a coating machine. A layer of catalyst containing palladium was uniformly gravure coated over one side of the film to a dry coating weight of approximately 1 $gm^{-2}$. The coated film is then passed through a printing machine and a vinyl lacquer flexo-printed ever the catalyst layer and dried; the layer is printed in a chosen pattern such that security thread manufactured from the film has regions corresponding to the clear regions identified in FIG. 1. The web is then passed through a hot air oven at 180° C. and the catalyst heat activated.

The web is then passed through a plating bath containing a cobalt solution as described in example 1. A layer of cobalt-based alloy was then electrolessly deposited over the regions of catalyst not covered by the patterned vinyl lacquer which constitutes a barrier to the deposition process. The resultant magnetic metal was thus deposited in a pattern according to FIG. 1.

We claim:

1. A method for manufacturing a security thread for use in security articles including security paper, said security thread comprising a polymeric substrate supporting a pattern of magnetic metal that provides a visually discernable security feature and a magnetically detectable security feature, said method comprising the steps of:

(a) providing a continuous polymeric web substrate, (b) applying a catalytic material comprising palladium on a surface of said web substrate in a manner that defines said pattern, (c) passing said web substrate with said pattern of catalytic material thereon through a solution containing magnetic metal comprising cobalt or cobalt alloy such that said magnetic metal will be electrolessly deposited on portions of the web substrate provided with said catalytic material so as to appear in said pattern, (d) applying a transparent protective layer over said pattern of magnetic metal, and (e) cutting said web substrate to provide said security thread.

2. A method as claimed in claim 1 wherein the magnetic metal comprises cobalt and phosphorous.

3. A method as claimed in claim 1, including between steps (b) and (c) a step of electrolessly depositing a non-magnetic metal directly on the catalyst, such that in step (c) the magnetic metal is deposited on top of the non-magnetic metal, the manufactured security thread thus including a layer of non-magnetic metal intermediate the catalytic material and the magnetic metal.

4. A method as claimed in claim 1, wherein step (b) comprises printing a printing solution containing the catalytic material on the surface of said web substrate.

5. A method as claimed in claim 4, wherein the printing solution is substantially free of tin.

6. A method as claimed in claim 1, wherein in step (a) said polymeric web substrate is dispensed as a continuous web by dispensing means, wherein in step (b) the continuous web is passed through means for depositing the catalytic material on the web, and wherein in step (c) the continuous web bearing catalytic material is passed through a solution containing the magnetic metal.

7. A method as claimed in claim 1, wherein in step (c) the magnetic metal is deposited on the substrate to a depth of 0.01–3.0 μm.

8. A method as claimed in claim 1, wherein in step (d) the protective coating is applied to the magnetic metal prior to step (e).

9. A method as claimed in claim 1, wherein the polymeric web substrate is transparent, such that the security thread is provided with a visually discernible security feature which is discernible in transmitted light.

10. A method as claimed in claim 1, wherein in step (c) the magnetic metal is deposited on the substrate in such a way that the security thread produced from the film provides a security feature detectable by a metal detector.

11. A method as claimed in claim 10, wherein in step (c) [where) the magnetic metal is deposited on the substrate in such a way that the conductivity of the magnetic metal can be used by a metal detector to detect the presence of the security thread produced from the film.

12. A method as claimed in claim 1, wherein in step (c) the magnetic metal is deposited on the substrate in such a way that detection of the magnetic metal.

13. A method as claimed in claim 1, wherein in step (e) the web substrate is slit.

14. A method as claimed in claim 1, wherein step (c) is a continuous process.

15. A method for manufacturing a security thread for use in security articles including security paper, said security thread comprising a polymeric substrate supporting a pattern of magnetic metal that provides a visually discernable security feature and a magnetically detectable security feature, said method comprising the steps of:

(a) providing a continuous polymeric web substrate, (b) applying a layer of catalytic material comprising palladium on a surface of said web substrate, (c) applying blocking means to said layer of catalytic material to define said pattern, (d) passing said web substrate with said pattern of catalytic material thereon through a solution containing magnetic metal comprising cobalt or cobalt alloy such that said magnetic metal will be electrolessly deposited on portions of the web substrate provided with said catalytic material so as to appear in said pattern, (e) applying a transparent protective layer over said pattern of magnetic metal, and (f) cutting said web substrate to provide said security thread.

16. A method as claimed in claim 15, wherein the magnetic metal comprises cobalt and phosphorous.

17. A method as claimed in claim 15, including between steps (c) and (d) a step of electrolessly depositing a non-magnetic metal directly on the catalyst, such that in step (d) the magnetic metal is deposited on top of the non-magnetic metal, the manufactured security thread thus including a layer of non-magnetic metal intermediate the catalytic material and the magnetic metal.

18. A method as claimed in claim 15, wherein step (b) comprises printing a printing solution containing the catalytic material on the surface of said web substrate.

19. A method as claimed in claim 18, wherein the printing solution is substantially free of tin.

20. A method as claimed in claim 15, wherein in step (d) the magnetic metal is deposited on the substrate to a depth of 0.01–3.0 μm.

21. A method as claimed in claim 15, wherein in step (e) the protective coating is applied to the magnetic metal prior to step (f).

22. A method as claimed in claim 15, wherein the polymeric web substrate is transparent, such that the security thread is provided with a visually discernible security feature which is discernible in transmitted light.

23. A method as claimed in claim 15, wherein in step (b) the catalytic material is uniformly applied over the surface of the web substrate, in step (c) a barrier coating is applied over portions of the applied catalytic material, the uncoated catalytic material being such as to provide said pattern, and in step (d) the magnetic material is deposited by an electroless process on only those portions of the catalytic material which are not covered by the barrier coating.

* * * * *

UNITED STATES PATENT AND TRADEMARK OFFICE

CERTIFICATE OF CORRECTION

PATENT NO. : 5,631,039
DATED : May 20, 1997
INVENTOR(S) : Knight et al.

It is certified that error appears in the above-indentified patent and that said Letters Patent is hereby corrected as shown below:

On the title page, item:

[30] Foreign Application Priority Data

Aug. 4, 1994 United Kingdom ..... 9415780.7
Aug. 9, 1994 United Kingdom ..... 9415931.6

Signed and Sealed this

Twelfth Day of August, 1997

Bruce Lehman

*Attest:*

BRUCE LEHMAN

*Attesting Officer*

*Commissioner of Patents and Trademarks*